US006578564B2

(12) United States Patent
Bagnasco

(10) Patent No.: US 6,578,564 B2
(45) Date of Patent: Jun. 17, 2003

(54) WIDE RANGE CONTROL METHOD FOR A FUEL VAPOR PURGE VALVE

(75) Inventor: Andrew P. Bagnasco, Plymouth, MI (US)

(73) Assignee: Delphi Technologies, Inc., Troy, MI (US)

( * ) Notice: Subject to any disclaimer, the term of this patent is extended or adjusted under 35 U.S.C. 154(b) by 98 days.

(21) Appl. No.: 09/956,489

(22) Filed: Sep. 19, 2001

(65) Prior Publication Data

US 2003/0051715 A1 Mar. 20, 2003

(51) Int. Cl.[7] ..... F02B 75/08
(52) U.S. Cl. ..... 123/698; 123/520
(58) Field of Search ..... 123/698, 520

(56) References Cited

U.S. PATENT DOCUMENTS 5,083,546 A * 1/1992 Detweiler et al. ..... 123/520
5,682,862 A * 11/1997 Sato et al. ..... 123/520
5,931,141 A * 8/1999 Chino ..... 123/520
6,173,703 B1 * 1/2001 Matsumoto ..... 123/674
6,176,228 B1 * 1/2001 Kerns ..... 123/698
6,196,203 B1 * 3/2001 Grieve et al. ..... 123/520
6,227,177 B1 * 5/2001 Yamafuji et al. ..... 123/520
6,234,156 B1 * 5/2001 Muto ..... 123/698
6,318,345 B1 * 11/2001 Weber et al. ..... 123/520
6,438,945 B1 * 8/2002 Takagi et al. ..... 60/283

* cited by examiner

*Primary Examiner*—John Kwon
(74) *Attorney, Agent, or Firm*—Vincent A. Cichosz

(57) ABSTRACT

An improved method of operation for an electromechanical purge valve of a vehicle evaporative emission control system reduces the activation level of the purge valve below a nominal minimum level by a variable offset amount under specified operating conditions to lower purge flow. Specifically, the low flow control is permitted when the fuel in the purge vapor being drawn into the engine exceeds a calibrated percentage of the engine fuel requirement and the activation level of the purge valve has been reduced to the nominal minimum, provided that the system voltage level is at or above a specified value. When low flow control is permitted, the offset amount is incrementally increased so long as the engine fuel control is able to maintain the air/fuel ratio error at or below a calibrated amount, and incrementally decreased when the low flow control is no longer permitted or the air/fuel ratio becomes lean enough to potentially degrade combustion stability.

7 Claims, 5 Drawing Sheets

WIDE RANGE CONTROL METHOD FOR A FUEL VAPOR PURGE VALVE

TECHNICAL FIELD

The present invention is directed to a method of operation for the fuel vapor purge system of an internal combustion engine, and more particularly to a method of operation for an electromechanical purge valve that achieves a wide range of flow control.

BACKGROUND OF THE INVENTION

Effective control of evaporative emissions in a motor vehicle powered by an internal combustion engine requires a system for storing fuel tank vapor in a charcoal canister, and for activating an electromechanical purge valve to allow the stored fuel vapor to be drawn into the intake-manifold of the engine for combustion in the engine cylinders. Ordinarily, the purge valve activation level is calibrated as a function of engine operating parameters such as speed and load so that the purge vapor flow is a desired percentage of the engine airflow. The hydrocarbon concentration of the purge vapor may be estimated, and the fuel injection quantity correspondingly adjusted to maintain accurate control of the cylinder air/fuel ratio. See, for example, the co-pending U.S. patent application Ser. No. 09/264,524, filed on Mar. 8, 1999, and Ser. No. 09/950,283 filed on Sep. 10, 2001, both of which are assigned to the assignee of the present invention, and incorporated by reference herein.

Since the purge vapor flow for a given purge valve opening is limited by the intake manifold vacuum level, there are certain low-vacuum conditions under which the purge flow with a standard fully-open purge valve is too low to prevent saturation of the charcoal canister. This can occur, for example, in engines designed to operate at near-atmospheric intake manifold pressure, or in stratified combustion mode engines where the intake air flow is controlled to regulate the air/fuel ratio to a relatively high value (in this case, high throttle openings increase the intake manifold pressure). This is typically addressed by using a high-flow (i.e., large-opening) purge valve so that the desired purge flow can be achieved even at low intake manifold vacuum levels. However, using a high flow purge valve effectively raises the minimum purge flow for a given engine vacuum because the normal control range of an electromechanical valve does not include very low activation levels for which the activation level vs. valve opening relationship is highly nonlinear. As a result, the minimum flow position of a high-flow purge valve can allow higher than desired purge flow under high fuel vaporization conditions, such as when an engine is idled in a high temperature environment and/or with highly volatile fuel. Accordingly, what is needed is a control method for extending the low-flow capability of an electromechanical purge valve by utilizing its non-linear operating range.

SUMMARY OF THE INVENTION

The present invention is directed to an improved method of operation for an electromechanical purge valve of a vehicle evaporative emission control system, wherein the activation level of the purge valve is reduced below a nominal minimum level by a variable offset amount under specified operating conditions. Specifically, the low flow control is permitted when the percent of fuel from purge vapor exceeds a calibrated value and the activation level of the purge valve has been reduced to the nominal minimum, provided that the system voltage level is at or above a specified value. When low flow control is permitted, the offset amount is incrementally increased to lower the valve activation level so long as the engine fuel control is able to maintain the air/fuel ratio error at or below a calibrated amount, and incrementally decreased to raise the valve activation level when the low flow control is no longer permitted or the air/fuel ratio becomes lean enough to potentially degrade combustion stability.

BRIEF DESCRIPTION OF THE DRAWINGS

FIG. 2 depicts a main flow diagram, FIG. 3 details a portion of the main flow diagram concerning system voltage enable logic, FIG. 4 details a portion of the main flow diagram concerning low purge flow enable logic, FIG. 5 details a portion of the main flow diagram concerning purge valve control, and FIG. 6 details a portion of the purge valve control concerning determination of the low flow offset amount.

DESCRIPTION OF THE PREFERRED EMBODIMENT

Figure 1:
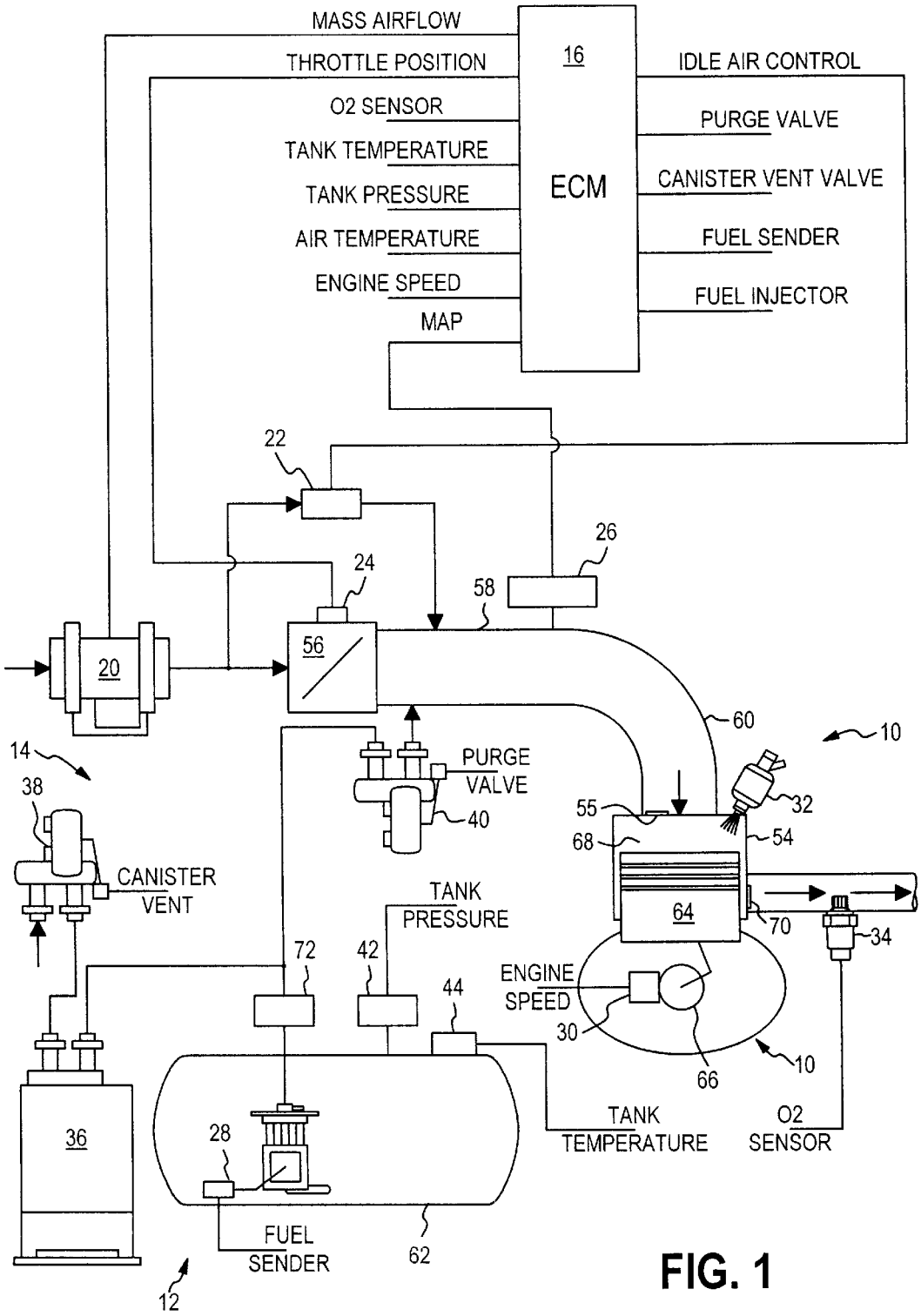
FIG. 1 is a system diagram of an internal combustion engine and evaporative emission system including an electromechanical purge valve and a microprocessor-based control unit for activating the purge valve in accordance with this invention.

The method of the present invention is disclosed in the context of a control system for an engine 10 in which fuel is injected directly into the engine cylinders, although it should be understood that the method equally applies to engines in which fuel is injected into intake runners upstream of the respective engine cylinders. A control system for engine 10 includes a fuel control system 12 and an evaporative emission control system (EECS) 14, both of which are controlled by a microprocessor-based engine control module (ECM) 16. In general, the EECS 14 manages evaporative emissions by storing fuel vapor and periodically releasing all or a portion of the stored vapor to engine 10 for combustion therein, and the fuel control system 12 injects a determined amount of fuel into engine 10, taking into account any fuel vapor supplied by EECS 14. In the illustrated embodiment, the fuel injection system 12 includes a mass airflow (MAF) sensor 20, and idle air control valve 22, a throttle position sensor 24, a manifold absolute pressure (MAP) sensor 26, a fuel sender 28, an engine speed sensor 30, a number of electrically activated fuel injectors 32, and a wide-range air/fuel (WRAF) exhaust gas sensor 34. The EECS 14 primarily includes a charcoal canister 36, electrically operated canister vent and purge valves 38, 40, and fuel tank pressure and temperature sensors 42, 44.

The ECM 16 executes a number of software routines for regulating the operation of the EECS 14 and the fuel control system 12, including functions such as fuel quantity calculations, fuel injection control, and fuel vapor purge control. Thus, ECM 16 receives output signals from the above-mentioned sensors 20, 24, 26, 28, 30, 34, 42, 44, and develops outputs signals for controlling idle air control valve 22, fuel injector 32, canister vent valve 38 and purge valve 40.

The fuel injectors 32 inject fuel directly into respective engine cylinders 54, as shown, and one or more intake valves 55 at each cylinder 54 open during an intake stroke to admit intake air and purged fuel vapor, if any. The intake air is ingested through a throttle valve 56 and an intake manifold 58 to which the various cylinders 54 are coupled by respective intake runners 60. The idle air valve 22 provides a by-pass around throttle valve 56, and its restriction is controlled by ECM 16 for purposes of regulating the engine idle speed. A piston 64 reciprocally disposed in each cylinder 54 and coupled to a rotary crankshaft 66 defines a combustion chamber 68 into which the fuel is injected. Following ignition of the air/fuel mixture by a spark plug (not shown), the products of combustion (that is, the exhaust gasses) exit the cylinder 54 through an exhaust valve 70 past WRAF sensor 34 to a catalytic converter and exhaust pipe (not shown). Operation of the engine 10 creates a sub-atmospheric pressure, or vacuum, in intake manifold 58, and the vacuum draws stored fuel vapor from canister 36 into intake manifold 58 through purge valve 40 as fresh air is drawn into canister 36 via vent valve 38. The fuel vapor stored in canister 36 originates in fuel tank 62, and is supplied to canister 36 via a rollover valve 72.

The ECM 16 controls the purge and vent valves 38, 40 so that the purge vapor flow is a desired percentage (PURGE_PCT_DES) of the engine airflow, where PURGE_PCT_DES is determined as a function of engine speed and load. When vapor purging is desired, the vent valve 38 is activated to a fully open state, and the purge valve 40 is variably activated by pulse-width-modulation (PWM) in which the modulation frequency is fixed, and the duty-cycle is scheduled open-loop for achieving PURGE_PCT_DES. Due to variations in engine operation and environmental conditions, the purge valve opening required to achieve PURGE_PCT_DES can vary over a relatively wide range. For example, the purge valve opening has to be large in engines designed for operation at near-atmospheric intake manifold pressure, and in direct injection engines operating in the stratified combustion mode. On the other hand, a small valve opening is required under high fuel vaporization conditions, such as when an engine is idled in a high temperature environment and/or with highly volatile fuel. This creates a problem because a purge valve designed to provide a large opening for low vacuum, high flow conditions when fully activated cannot be reliably controlled to a small enough opening under high fuel vaporization conditions. Theoretically, of course, the valve opening could be made smaller and smaller by simply reducing the activation level of the valve, but the valve opening for given activation level under such conditions varies widely from valve to valve, and with changes in environmental and other conditions, so that a given valve opening smaller than a certain size cannot be reliably achieved. For this reason, valve manufacturers typically specify a nominal minimum activation level which will reliably produce a desired valve opening within specified tolerance levels.

The present invention addresses the above-described problem with a control method that extends the low-flow capability of an electromechanical purge valve below the nominal minimum activation level. In this way, the maximum opening of the valve may be sized to provide sufficient purge flow under low vacuum conditions, and the control method operates the valve below its nominal minimum activation level to prevent excessive vapor purge flow under high fuel vaporization conditions. According to the invention, the low-flow control is enabled when the percentage of fuel from purge vapor exceeds a calibrated value and the activation level of the purge valve has been reduced to the nominal minimum, provided that the system voltage level is at or above a minimum energization voltage for reliably operating the valve at an activation level below the nominal activation level.

The hydrocarbon concentration of the purge vapor may be estimated based on the output of an exhaust gas oxygen sensor, as described in the aforementioned U.S. patent application Ser. Nos. 09/264,524 and 09/950,283, both of which are assigned to the assignee of the present invention, and incorporated herein by reference. In the illustrated embodiment, engine 10 may be operated in either homogeneous or stratified combustion modes, and different methods are used to estimate the hydrocarbon concentration of the purge vapor is depending on the combustion mode. In the homogeneous mode, fuel is injected so that the air/fuel mixture is evenly distributed throughout the cylinder 54 when the mixture is ignited during the ensuing combustion stroke, and a closed-loop fuel control adjusts base fuel injection quantity to maintain the air/fuel ratio at a desired value at or near the stoichiometric ratio. In this case, the hydrocarbon concentration of the purge vapor is estimated by an iterative process in which the estimate is incrementally increased or decreased if an integral of the measured air/fuel ratio error reaches respective rich or lean thresholds. When fuel vapor is not being purged, the integral of the measured air/fuel ratio error is used to update a closed-loop adaptive learning table. See the aforementioned U.S. patent application Ser. No. 09/264,524. In the stratified mode, the fuel is injected just prior to the ignition event, resulting in a rich air/fuel mixture in the vicinity of the spark plug at ignition; the injected fuel quantity is scheduled open-loop to achieve a commanded engine torque output, and the throttle valve 56 is adjusted to maintain the air/fuel ratio in a range significantly higher than the stoichiometric ratio. Under these conditions, there may be substantial error between the actual and desired air/fuel ratio even under steady-state operating conditions, and the air/fuel ratio error for purposes of estimating the purge vapor concentration is normalized for air/fuel ratio errors that exist under steady-state engine operation when the purge valve 40 is not activated. See the aforementioned U.S. patent application Ser. No. 950,283.

When low flow control is permitted, the activation level of the purge valve is reduced by an offset amount that is incrementally increased so long as the engine fuel control is able to maintain the air/fuel ratio error at or below a calibrated amount, and incrementally decreased when the low flow control is no longer permitted or the air/fuel ratio becomes lean enough to degrade combustion stability. In other words, activating the purge valve at a level below the nominal minimum level will likely produce purge flow error due to valve nonlinearities as discussed above, and if the error is not too large, the fuel control will be able to adjust the fuel injection amount as required to maintain the air/fuel ratio error reasonably close to the desired value. In this way, the activation level of the purge valve is reduced below the nominal activation level to approach the desired purge percentage under high fuel vaporization conditions, so long as reasonably accurate air/fuel ratio control is maintained and the system voltage is sufficient to ensure reliable valve operation at the reduced activation level. The activation level is not allowed under any circumstance to be less than an absolute minimum level for reliable operation at the worst case voltage level. The amount by which the activation level may be reduced below the nominal minimum level will vary depending on valve and environmental conditions, but the dynamic range of the valve will be increased in any event.

Figure 2:
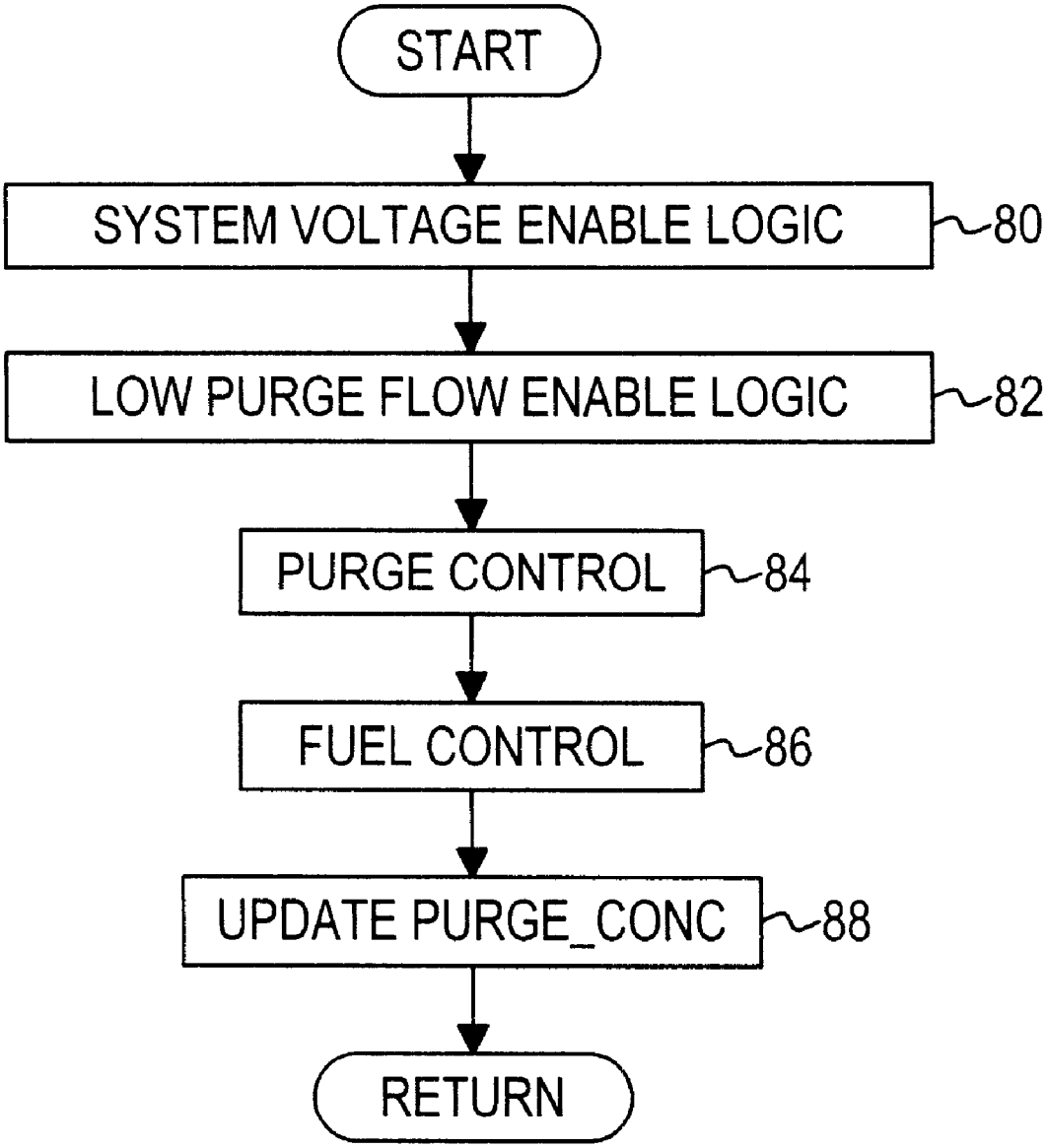
FIGS. 2–6 are flow diagrams depicting a software routine executed by the control unit of FIG. 1 in carrying out the control of this invention.

The flow diagrams of FIGS. 2–6 depict a software routine periodically executed by ECM 16 for carrying out the control method of this invention. FIG. 2 depicts a main flow diagram, while FIGS. 3–6 detail various portions of the routine referenced in FIG. 2.

Referring to FIG. 2, the main flow diagram involves periodically executing the blocks 80–88. Block 80 involves comparing the system voltage to a minimum energization voltage for reliably operating purge valve 40, and setting the status of the VOLT_ENABLE flag accordingly; see FIG. 3. Block 82 involves determining whether the various low flow entry conditions have been met and setting the status of the LOW_FLOW flag accordingly; see FIG. 4. Block 84 involves determining the desired purge concentration and a PWM duty cycle (PURGE_DC) for purge valve 40; see FIGS. 5–6. Block 86 adjusts the fuel injection quantity to take into account the fuel obtained due to vapor purging, and block 88 updates the hydrocarbon concentration estimate (PURGE_CONC) of the purge vapor, as described above.

Figure 3:
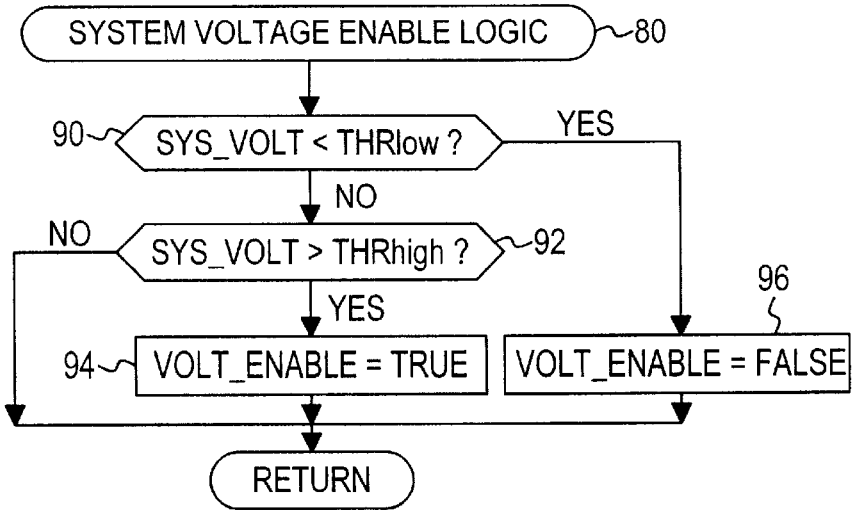

Referring to the system voltage enable logic of FIG. 3, the blocks 90 and 92 compare the system voltage SYS_VOLT to upper and lower thresholds THRlow, THRhigh defining a minimum energization voltage for reliably operating purge valve 40. If SYS_VOLT is above THRhigh, the block 94 sets the VOLT_ENABLE flag to TRUE, while if SYS_VOLT falls below THRlow, the block 96 sets the VOLT_ENABLE flag to FALSE.

Figure 4:
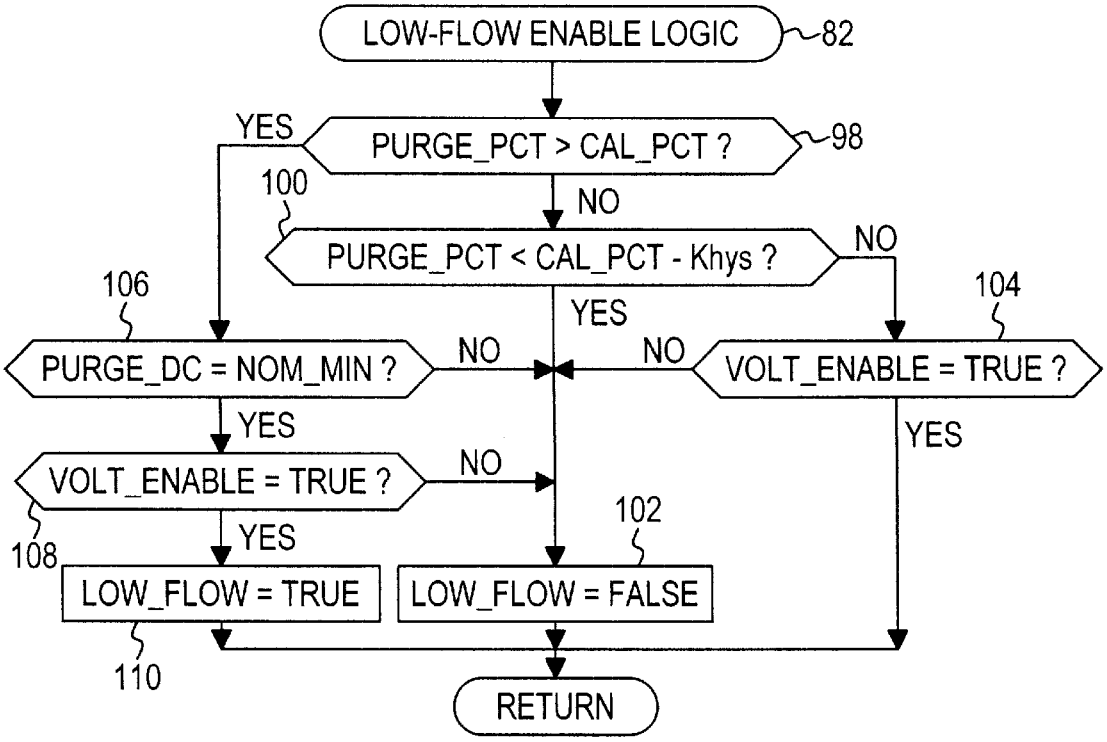

Referring to the low-flow enable logic of FIG. 4, the blocks 98–100 determine if the percent of fuel from purge vapor, PURGE_PCT, is greater than a calibration value CAL_PCT_FUEL, the blocks 106 and 108 are executed to determine if PURGE_DC is at the nominal minimum activation level NOM_MIN, and if the VOLT_ENABLE flag is TRUE. If all three conditions are met (that is, if blocks 98, 106 and 108 are answered in the affirmative), the block 110 sets the LOW_FLOW flag to TRUE. If blocks 106 or 108 is answered in the negative, or if block 100 determines that PURGE_PCT falls below the quantity (CAL_PCT_FUEL-Khys), the block 102 is executed to set the LOW_FLOW flag to FALSE. If PURGE_PCT is between CAL_PCT_FUEL and (CAL_PCT_FUEL-Khys), the block 104 is executed to determine if the VOLT_ENABLE flag is TRUE. If so, the status of the LOW_FLOW flag is unchanged; if not, the block 102 is executed to set the LOW_FLOW flag to FALSE.

Figure 5:
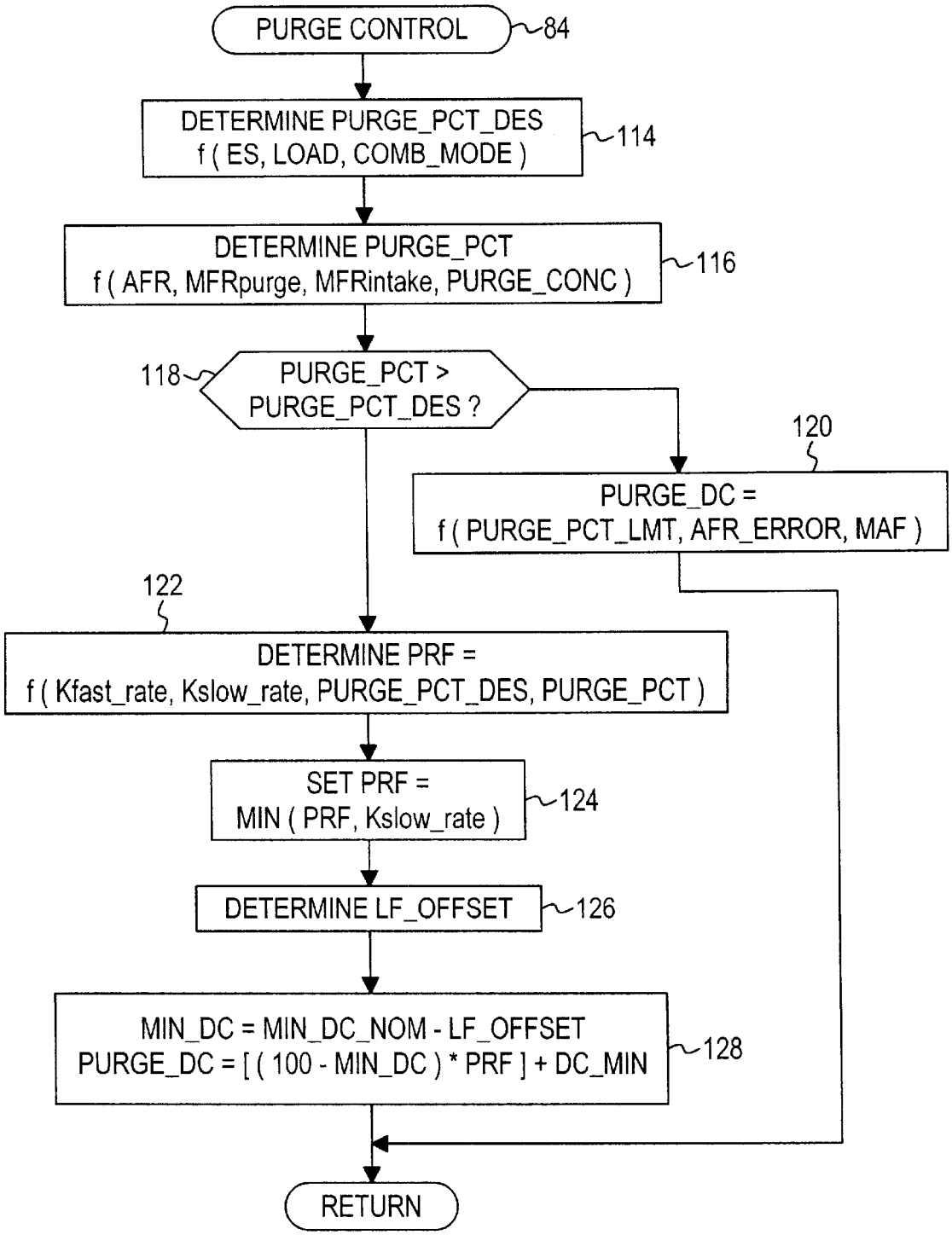

Referring to FIG. 5, determining PURGE_DC involves determining a desired percentage of purge vapor (PURGE_PCT_DES) as indicated at block 114, determining a purge rate factor PRF based on the deviation of the current purge vapor percent PURGE_PCT from PURGE_PCT_DES, updating the minimum duty cycle MIN_DC based on the low-flow offset LF_OFFSET, and then determining PURGE_DC based on PRF and the minimum duty cycle MIN_DC. The determination of LF_OFFSET is described below in reference to FIG. 6.

As indicated at block 114, the PURGE_PCT_DES is determined primarily as a function of engine speed (ES) and load (LOAD) for the current combustion mode of engine 10. The percent of fuel from purge vapor, PURGE_PCT, is determined at block 116 as a function of the air/fuel ratio (AFR), the purge vapor mass flow rate (MFRpurge), the intake mass flow rate (MFRintake) and PURGE_CONC, as follows:

$$\text{PURGE_}PCT=(\text{PURGE_}CONC*MFR\text{purge}*AFR)/MFR\text{intake} \quad (1)$$

The quantities MFRpurge and MFRintake may be measured or estimated based n various factors, as disclosed for example, in the U.S. Pat. No. 5,845,627, issued on Dec. 8, 1998, and incorporated herein by reference. If PURGE_PCT is less than or equal to PURGE_PCT_DES, as determined at block 118, the block 120 sets PURGE_DC to a value based on PURGE_PCT_DES, the air/fuel ratio error AFR_ERROR, and the measured mass air flow MAF. If AFR_ERROR is reasonably low, PURGE_DC is adjusted to achieve PURGE_PCT_DES; however, PURGE_DC is controlled to achieve a value less than PURGE_PCT_DES if AFR_ERROR indicates that there is significant fueling error. If PURGE_PCT is greater than PURGE_PCT_DES, the blocks 122 and 124 are executed to determine a ramp factor PRF for controlling the rate of change of PURGE_DC. The value of PRF computed at block 122 according to the expression:

$$PRF=(K\text{fast_rate}*\text{PURGE_}PCT_LMT/\text{PURGE_}PCT)+[(1-K\text{fast_rate})*K\text{slow_rate}] \quad (2)$$

where Kfast_rate and Kslow_rate are calibrated values corresponding to the predetermined changes per unit time in the value of PURGE_DC. For example, Kfast_rate may be 0.60, corresponding to a 40% reduction of PURGE_DC each time PRF is applied to PURGE_DC, and Kslow_rate may be 0.95, corresponding to a 5% reduction of PURGE_DC each time PRF is applied to PURGE_DC. Thus, if PURGE_PCT is only slightly higher than PURGE_PCT_LMT, as may occur in normal purge control, PRF will be approximately equal to Kslow_rate. On the other hand, if PURGE_PCT is significantly higher than PURGE_PCT_LMT, as may occur when the combustion mode switches from homogeneous to stratified, the product [Kfast_rate*(PURGE_PCT_LMT/PURGE_PCT)] becomes smaller, resulting in a smaller value of PRF and a faster reduction of PURGE_-DC. The block 124 sets the purge rate factor PRF equal to the lower of the PRF value computed at block 122 and Kslow_rate. The block 126 updates the low flow offset LF_OFFSET, as described below in reference to FIG. 6, and the block 128 updates PURGE_DC by applying LF_OFFSET to the nominal minimum duty cycle MIN_DC_NOM, and then computing PURGE_DC according to:

$$\text{PURGE_}DC=[(100-MIN_DC)*PRF]+MIN_DC \quad (3)$$

Figure 6:
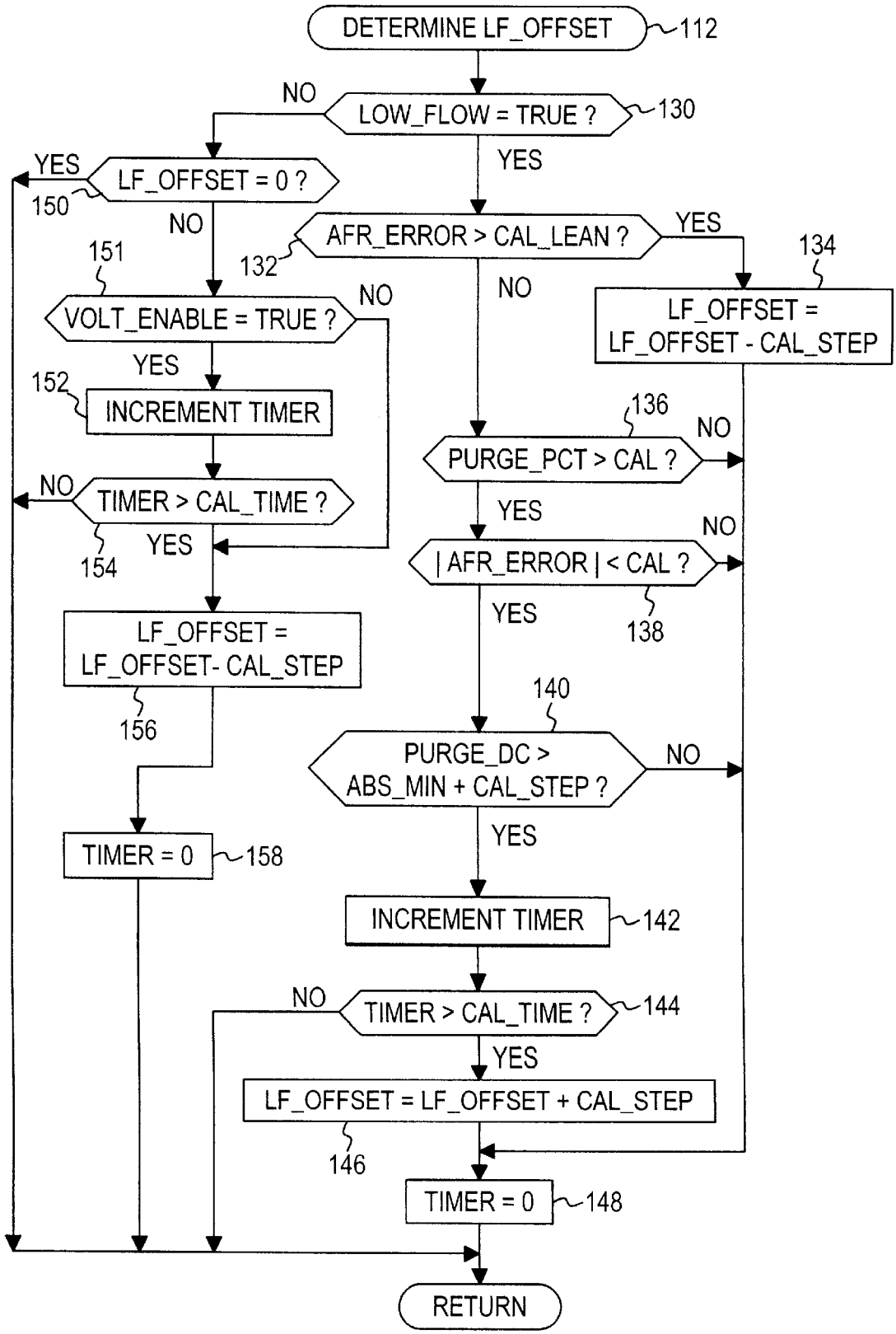

Referring to FIG. 6, determining LF_OFFSET initially involves executing block 130 to determine if the LOW_FLOW flag is TRUE. In general, if the LOW_FLOW flag is TRUE, LF_OFFSET is incrementally increased toward a limit value to correspondingly reduce MIN_DC if block 130 is answered in the affirmative, the air/fuel ratio error AFR_ERROR is relatively low, and PURGE_PCT is greater than a calibrated value. Referring to the flow diagram, the blocks 142–148 are executed to increase LF_OFFSET if block 132 is answered in the negative and blocks 136, 138 and 140 are answered in the affirmative. Block 132 determines if AFR_ERROR is greater than a calibrated threshold CAL_LEAN indicative of an excessive uncorrected air/fuel ratio error in the lean direction. Block 136 determines if PURGE_PCT is greater than a calibrated value such as 20%, and block 138 determines if the magnitude of AFR_ERROR is less than a calibrated value such as 5%. Finally, block 140 determines if incrementing LF_OFFSET by the step increment CAL_STEP would reduce PURGE_DC below an absolute minimum level ABS_MIN. If the conditions for incrementing LF_OFFSET are satisfied, the block 142 increments a TIMER, and blocks 144–146 increase LF_OFFSET by CAL_STEP when TIMER reaches a calibrated threshold CAL_TIME. The block 148 resets TIMER to zero each time LF_OFFSET is increased. If at any time during low-flow control block 132 is answered in the affirmative, the block 134 is executed to immediately decrease LF_OFFSET by CAL_STEP, thereby immediately increasing MIN_DC to increase PURGE_DC; this serves to prevent degraded driveability due to exceeding the lean combustion limit in situations where the purge vapor fuel is a significant percentage of the engine fuel requirement. If block 132 continues to be answered in the negative, but blocks 136, 138 or 140 are answered in the negative, the block 148 is executed to reset the TIMER to zero, thereby postponing further increases in LF_OFFSET.

If the LOW_FLOW flag is FALSE and LF_OFFSET is non-zero, as determined at blocks 130 and 150, the blocks 151–158 are executed to decrease LF_OFFSET for exiting the low-flow control mode. If the VOLT_ENABLE flag is TRUE, as determined at block 151, the block 152 increments a TIMER, and blocks 154–156 decrease LF_OFFSET by CAL_STEP when TIMER reaches a calibrated threshold CAL_TIME. If block 151 determines that the VOLT_ENABLE flag is FALSE, however, the blocks 152–154 are skipped, and the block 156 is immediately executed to decrease LF_OFFSET by CAL_STEP. In either event, the block 158 resets TIMER to zero each time LF_OFFSET is decreased.

In summary, the control of the present invention allows purge valve 40 to be operated below its nominal minimum level by a variable offset amount under specified conditions to effectively expand the dynamic range of purge flow control. When low flow control is permitted, the activation level of the valve is incrementally decreased so long as the engine fuel control is able to maintain the air/fuel ratio error at or below a calibrated amount, and incrementally increased when the low flow control is no longer permitted or the air/fuel ratio has become lean enough to potentially degrade combustion stability.

While the present invention has been described in reference to the illustrated embodiment, it is expected that various modifications in addition to those mentioned above will occur to those skilled in the art. Thus, it will be understood that methods incorporating these and other modifications may fall within the scope of this invention, which is defined by the appended claims.

What is claimed is:

1. A method of operation for an internal combustion engine having a fuel control for maintaining an air/fuel ratio of said engine at a desired value, and a fuel vapor purge system including a purge valve that is electrically activated at a variable level to define an effective opening corresponding to such activation level through which stored fuel vapor is purged into said engine, said purge valve having a nominal minimum activation level for reliably defining a corresponding minimum effective opening, the method comprising the steps of:

estimating a percentage of engine fuel supplied by said purged fuel vapor;

initiating a low flow control of said purge valve when the estimated percentage exceeds a calibrated value and the activation level of the purge valve has been reduced to said nominal minimum level; and when said low flow control is initiated, progressively reducing said activation level below said nominal minimum level to define effective openings of said valve that are smaller than said minimum effective opening so long as the air/fuel ratio of said engine is within a calibrated amount of said desired value.

2. The method of operation of claim 1, including the step of:

interrupting the progressive reduction of said activation level when said activation level reaches a calibrated minimum activation level which is lower than said nominal minimum activation level.

3. The method of operation of claim 2, wherein said calibrated minimum activation level corresponds to an activation level for obtaining reliable operation of said valve when a system voltage used to activate said valve is at a specified minimum value.

4. The method of operation of claim 3, including the step of:

preventing initiation of said low flow control when the system voltage is below said specified minimum value.

5. The method of operation of claim 3, including the step of:

terminating said low flow control by increasing said activation level to said nominal minimum activation level when the system voltage falls below said specified minimum voltage.

6. The method of operation of claim 1, including the step of:

terminating said low flow control by progressively increasing said activation level when said estimated percentage falls below said calibrated value.

7. The method of operation of claim 1, wherein said low flow control includes the step of:

progressively increasing said activation level if said air/fuel ratio becomes lean enough to potentially degrade combustion stability in said engine.

* * * * *